United States Patent [19]

Mayer

[11] Patent Number: 4,805,783

[45] Date of Patent: Feb. 21, 1989

[54] SLAT WALL ADVERTISING PANEL

[76] Inventor: John R. Mayer, W223 N4971 East View Dr., Sussex, Wis. 53089

[21] Appl. No.: 889,806

[22] Filed: Jul. 23, 1986

[51] Int. Cl.[4] ..... A47B 47/00

[52] U.S. Cl. ..... 211/94; 211/189

[58] Field of Search ..... 211/94, 57.1, 59.1, 211/189, 194, 191, 133, 188, 191; 52/28, 588

[56] References Cited

U.S. PATENT DOCUMENTS

| | | | |
|---|---|---|---|
| 2,052,755 | 9/1936 | Duffy | 52/28 X |
| 2,589,304 | 3/1952 | Spangler | 52/588 |
| 4,323,163 | 4/1982 | Johns | 211/189 |
| 4,420,087 | 12/1983 | Johns | 211/189 |
| 4,450,970 | 5/1984 | Shepherd | 211/189 |
| 4,604,753 | 8/1986 | Rodek | 211/189 X |

*Primary Examiner*—Alvin C. Chin-Shue
*Assistant Examiner*—Sarah A. Lechok Eley
*Attorney, Agent, or Firm*—Ronald E. Barry

[57] ABSTRACT

A slat wall display apparatus including a panel assembly formed from a number of panels having connecting channels formed on the panels and a connector for matingly engaging the connecting channels, the connector having "T" shaped, hook-shaped, or circular-shaped edges to matingly engage the channels, the panel assembly being mounted in a floor or wall frame, one or more of the panels including a light for illuminating the panel assembly.

13 Claims, 3 Drawing Sheets

SLAT WALL ADVERTISING PANEL

BACKGROUND OF THE INVENTION

Display apparatus of the type contemplated herein generally include a rigid backing plate or wall having a preformed modular panel mounted on either one or both sides of the backing wall. Each of the modular panels is provided with a series of ribs projecting outwardly from the wall and having a vertical strip formed on the outer edges of the ribs and spaced one from the other to form horizontal slots. Display hangers are positioned in the slots for displaying articles of merchandise. This type of display apparatus is heavy, making it difficult to handle and requires considerable storage space.

SUMMARY OF THE INVENTION

The slat wall display apparatus according to the present invention is made up of a series of rectangular panels—which are interengageable to form the slat wall display apparatus. Each of the panels is light in weight, relatively small for storage and handling and sufficiently rigid to support the display hangers. The panels can be quickly and easily assembled and can be supported by a light weight peripheral frame which can be easily moved about the display area. The panels can be assembled to any height and arranged in any configuration to take advantage of the area available for display. The panels can also be assembled for mounting on a wall.

IN THE DRAWINGS

This invention is best understood by reference to the accompanying drawings, of which:

DESCRIPTION OF THE INVENTION

Figure 1:
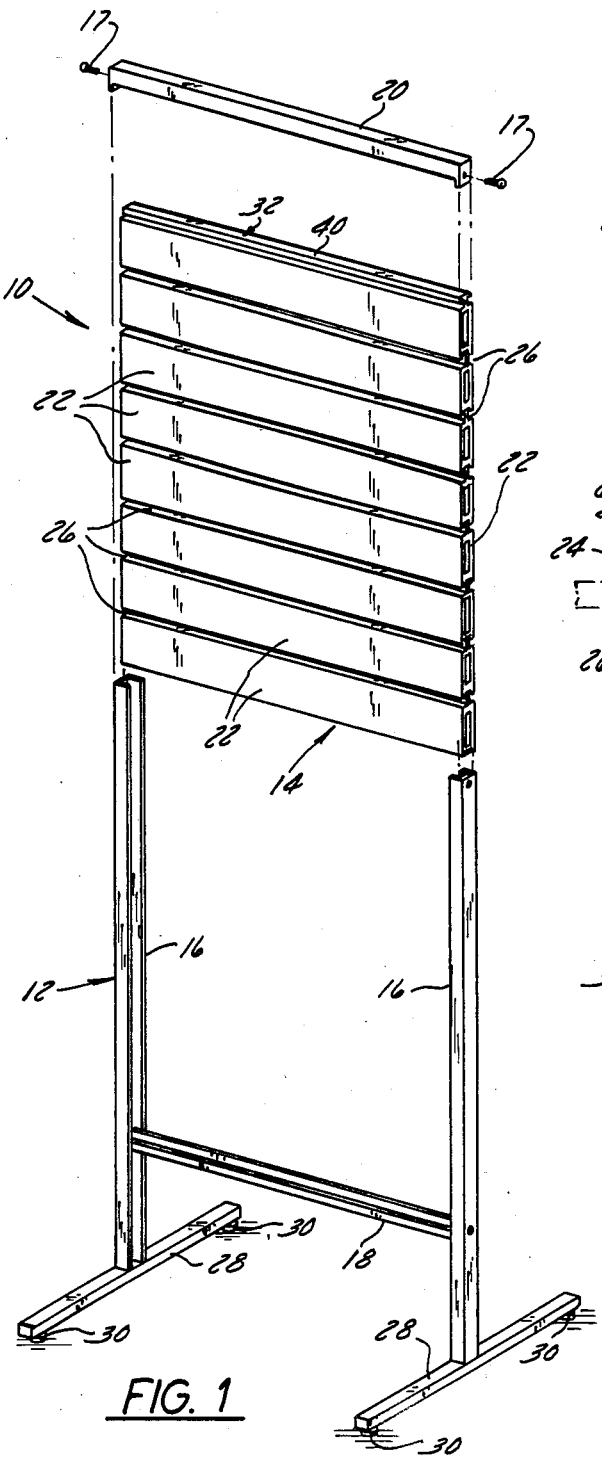
FIG. 1 is a perspective exploded view of the advertising display apparatus according to the invention.

As seen in FIG. 1 of the drawings, the slat wall display apparatus 10 includes a frame 12 and a panel assembly 14. The frame 12 includes side wall channel members 16, a bottom channel member 18 and a top channel member 20. The panel assembly 14 is formed from a number of independent panels 22 or 50 which are preassembled and aligned with the channel members 16 for the frame 12. The panel assembly 14 is inserted into the channel members 16 and allowed to slide downward until the assembly 14 rests on the bottom channel member 18. The top channel member 20 is placed over the top of the panel assembly 14 and secured to channel members 16 by screws or pins 17. Display hangers 24 can then be inserted into the slots 26 formed between the panels 22 in the panel assembly 14.

The frame 12 as described above is a basic frame structure which can be combined with a number of similar frames to provide various display arrangements. As seen in FIG. 1, the side wall channel members 16 are supported by means of base members 28 secured to the bottom of the side wall channel members 16. The base members 28 are shown in the form of bars having footings 30 located at each end for supporting the frame on the floor. It should be noted that rollers could be substituted for the footings 30 if the display apparatus is to be moved.

The panel assembly 14 is made up of a number of rectangular panels 22 of equal lengths. Each panel includes side walls 21, located in a parallel spaced relations and closed by a top wall 25 and a bottom wall 27. Means are provided for interconnecting the adjacent panels 22 to form the panel assembly 14. Such means is in the form of a "T" connector 32 as seen in FIGS. 2 and 4.

Figure 2:
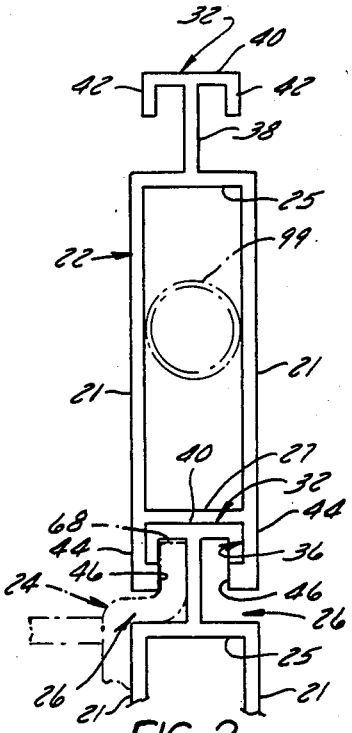
FIG. 2 is a side elevation view partly broken away showing one form of panels which are used to make up the panel assembly.
Figure 4:
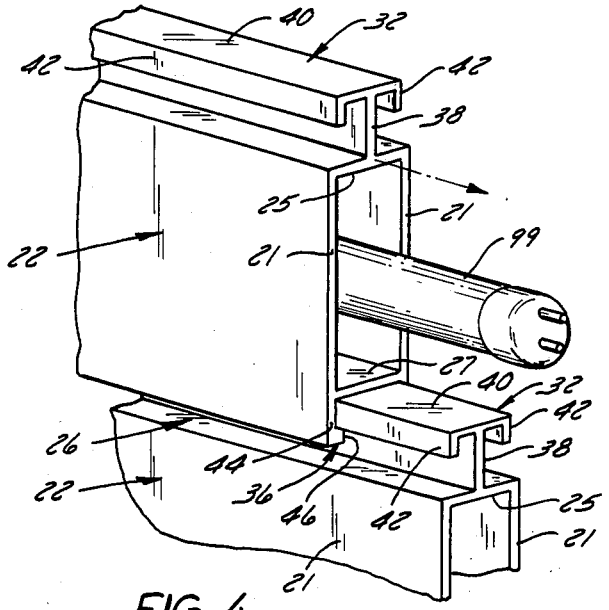
FIG. 4 is a perspective view partly broken away to show the "T" connector for the panels of FIG. 2.

In this regard and referring to FIGS. 2 and 4, each of the panels 22 is in the form of an elongate extruded hollow member having a "T" connector 32 formed along the top wall 25 and a "T" shaped channel 36 formed along the bottom wall 27 of the panel 22. The "T" connector 32 includes a web 38 and a cross member 40 having a depending flange 42 on each edge of the cross member 40. The "T" shaped channel 36 is formed by extensions 44 provided on the walls 21. Flanges 46 are provided on the inside edges of the ends of the side wall extensions 44. The flanges 46 are spaced apart a distance greater than the width of the web 38 to allow space for the display hangers 24. The flanges 46 are also located a distance from the bottom wall 27 of the panel which is equal to the length of the flanges 42 provided on the edges of the cross member 40. When the "T" connector 32 is inserted into the "T+-shaped channel 36, it should form a snug fit to provide stability between the panels 22 as well as being spaced apart to form a slot 26 to accommodate the display hangers 24.

With this arrangement, the panels 22 can be packed in kits and shipped or stored as needed. The frame 12 can also be broken down to its basic units for shipment and storage. The entire unit being extremely light and easy to carry. It should also be noted that the slots 26 are provided on both sides of the panel assembly, thus reducing the width of the panels and further minimizing weight.

Figure 3:
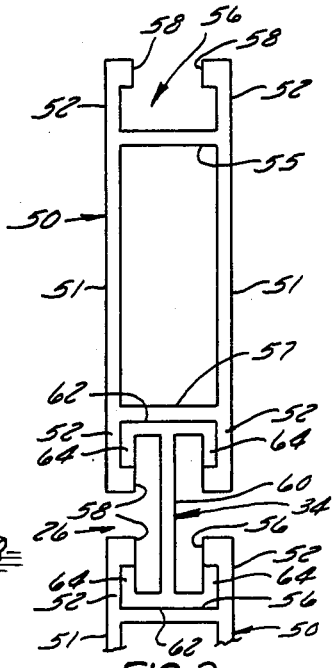
FIG. 3 is a side elevation view of another form of the panels used to make up the panel assembly.
Figure 5:
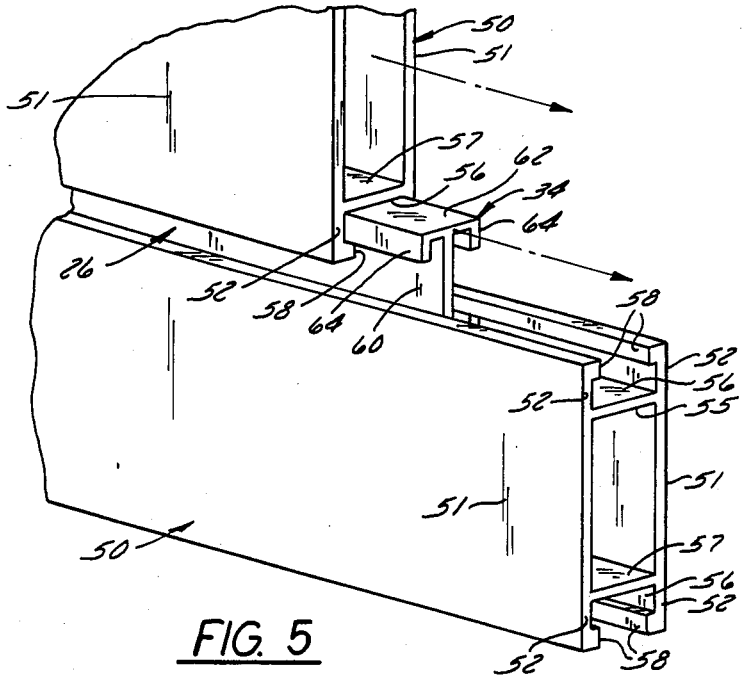
FIG. 5 is a perspective view partly broken away showing the double-"T" connector for the panels of FIG. 4.

In the alternate embodiment the panels 50 as seen in FIGS. 3 and 5, are connected by means of a double "T" connector 34. The panels 50 are again formed as elongate extruded hollow rectangular tubular members having front walls 51, a top wall 55 and a bottom wall 57. The front walls 51 are provided with extensions 52 on the top and bottom. Flanges 58 are provided along the inside edge of the extensions 52 to define the "T" type channel 56 for the double "T" connector 34.

In this regard, the double "T" connector 34 includes a center web or base 60 and cross members 62 along each edge of the web. A flange 64 is provided along each edge of the cross members 62. The flanges 64 have a length equal to the space between the flange 58 and the walls 25 and 27, whereby the double "T" connector 34 will form a snug fit upon insertion into the channel 56. The height of the web 60 should be sufficient to provide a slot 26 to accommodate the display hangers 24. The display hangers 24 are conventional and have an offset flange 68 which fits snugly in the space between the web 38 or 60 and the corresponding flange 46 or 58.

The slat wall panel assembly 14 formed by the panels 22 shown in FIGS. 3 and 5 provides the same advantages as described above with the added advantage of the extrusions being symmetrical in configuration so that they can be mounted at any position in the panel assembly.

An additional feature of the display apparatus is the the ability to illuminate one or more of the panels 22 or 50 to attract the attention to the display apparatus. This is accomplished by forming the panels of a translucent material and providing light means in the panel. Such means can be in the form of a neon tube 99 or similar device mounted either inside of the panel as seen in FIG. 2 or behind the panel or with a spot light located on the back of the assembly.

Figure 6:
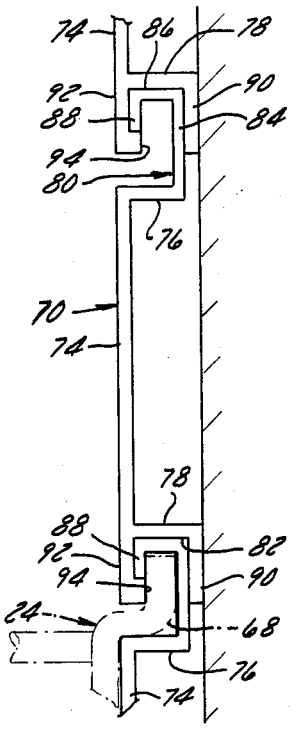
FIG. 6 is an alternate embodiment of the panels.
Figure 7:
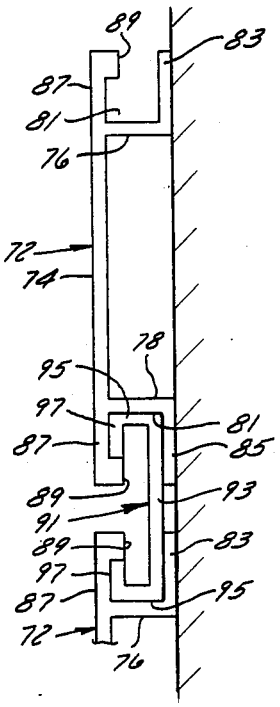
FIG. 7 is an end view of the panel of FIG. 7 connected to a double connector.
Figure 8:
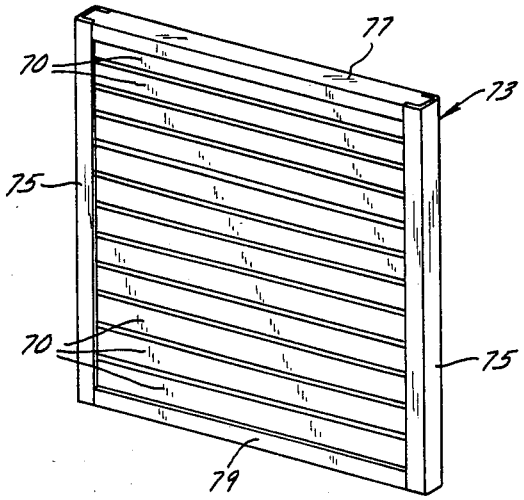
FIG. 8 is a perspective view of the embodiment shown in FIG. 6 mounted in a wall frame.

In the alternate embodiment of the invention shown in FIGS. 6 and 7, the panels 70, 72 have been modified for use as a wall-mounted display apparatus. The extruded panels 70, 72 are half the thickness of the panels 22, 50. The panels 70, 72 are mounted in a peripheral wall frame 73 which is formed from side channel members 75 and a top channel member 77 and a bottom channel member 79. The panel 70 includes a front wall 74, a top wall 76, a connector 80 along the top wall and a corresponding channel 82 is provided on the bottom wall 78. The connector 80 includes a web 84 having a cross member 86 located along the top of the one side of the web 84 and a flange 88 depending from the outer edge of the cross member 86 forming a hook-shaped member. The channel 82 is formed by providing an extension 90 on the edge of the bottom wall 78 and an extension 92 from the front wall 74 which terminates at a flange 94. The hook-shaped connector 80 is slideably received in the channel 82 to form a snug fit.

In the embodiment shown on FIG. 7, the panel 72 is formed with a front wall 74, a top wall 76, a bottom wall 78. Channels 81 are provided at the top and the bottom which are formed by a flange 83 provided on the edge of the top wall 76 and a flange 85 provided on the edge of the bottom wall 78. Extensions 87 are provided at the top and bottom of the wall 74 which are provided with flanges 89 at the end of the extension. A double connector 91 is used to connect the adjacent panels 72. The connector 91 includes a web 93 having a cross member 95 along each edge of the web and a flange 97 on the edges of the cross members 95 to form a double hook-shaped connector. Display hangers 24 can be mounted in the slots provided between the panels 70 or 72 by inserting the offset flange 68 into the slot between the panels.

Figure 9:
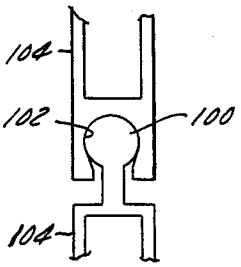
FIG. 9 is a view of an alternate form of connector.

An alternate form of connector 101 is shown in FIG. 9 which includes a circular ball-shaped member 100 which fits in a dovetail type channel 102 provided in the panel 104. The connector can be formed as an integral part of the panel 104 or as a separate connector having a ball-shaped member on both edges in the form of a double connector as described above.

I claim:

1. An advertising display apparatus comprising a panel assembly formed from a number of hollow rectangular panels of equal length, width and height, each panel having connecting means along the top and bottom, said connecting means at the top of each panel matingly engaging the connecting means on the bottom of the adjacent panel and a frame for enclosing the top, bottom and ends of the said panel assembly whereby said assembly is maintained in a vertical relation, said panels being spaced apart by said connecting means to form horizontal slots on both sides of said panels whereby display hangers of the type having an offset flange can be mounted in the slots between the panels.

2. The apparatus according to claim 1 wherein said connecting means comprises a "T" connector provided along the top of each of said panels and a "T" channel provided along the bottom of each of said panels, said "T" connector being shaped to matingly engage the "T" channel along the bottom of the panel.

3. The apparatus according to claim 1 wherein said connecting means comprises a ball-shaped member along the top of each connector and a ball-shaped channel along the bottom of each panel, said ball-shaped members matingly engaging said ball-shaped channel.

4. The apparatus according to claim 1 wherein said panels are formed from a translucent material and including means for illuminating each of said panels.

5. The apparatus according to claim 4 wherein said illuminating means comprises a light source located in one or more of the panels.

6. A two-sided display panel assembly comprising a member of hollow rectangular panels of equal length, width and height.

a "T" shaped connector formed on the top of each panel, a "T" shapped channel formed on the bottom of each panel, said channel corresponding in shape to the "T" shapped connector on the top of said panel whereby said panels can be connected to form the panel assembly by sliding said "T" shaped connector into said "T" shaped channel.

7. the panel assembly assembly according to claim 6 wherein said "T" shaped connectors are formed with a web on the top of the panel and a cross member mounted on the top of the web, said "T" shaped channels are formed by an extension along each side of the bottom of said panel and a flange along the inside of the bottom of the extension, said flanges being spaced a distance from the bottom of the panel sufficient to accomodate the cross members and spaced apart a distance greater than the width of the web to define a slot on both sides of the panel to accomodate an offset flange type display hangers.

8. The display assembly according to claim 7 wherein said web has a height greater than the height of said extensions to form a slot on both sides of said web between the bottom of said extensions and the top of the adjacent panel.

9. A two sided display assembly comprising a number of hollow rectangular panels having equal length, width and height, each panel including a T-shaped channel along the top and the bottom and a number of double T-shaped connectors for interconnecting said panels, said double T-connectors each including a web and a cross member mounted on the longitudinal edges of said web, said cross members forming a T with the web which corresponds in shape to said T-shaped channel members formed on the panels whereby said panels are connected by sliding a double T-connector into the T-channel on the bottom of one panel and the T-channel on the top of the adjacent panel.

10. The panel assembly according to claim 9 wherein said channels are formed by extensions provided on the top and the bottom of each panel and a flange at the end of each extension spaced a distance from the bottom of the panel sufficient to accomodate said cross member and spaced apart a distance less than the width of the web to form a slot on both sides of the web to accomodate an off-set flange type display hanger.

11. The panel assembly according to claim 10 including a flange depending from the edge of the cross member, said cross member flanges filling the space between the extension flanges and the panel to stabilize the said assembly.

12. The panel assembly according to claim 6 or 9 including a self standing frame for enclosing the sides, top and bottom of said panel assembly to provide access to both sides of said panel assembly.

13. The panel assembly according to claim 6 or 9 wherein said panels are formed from translucent material and including a light in one or more of said panels to illuminate said panel assembly.

* * * * *